US010128604B2

(12) United States Patent
Li et al.

(10) Patent No.: US 10,128,604 B2
(45) Date of Patent: Nov. 13, 2018

(54) ELECTRICAL CONNECTOR ASSEMBLY

(71) Applicant: Molex, LLC, Lisle, IL (US)

(72) Inventors: Yue-You Li, Dongguan (CN); Xiao-An Wang, Dongguan (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/655,514

(22) Filed: Jul. 20, 2017

(65) Prior Publication Data

US 2018/0034189 A1 Feb. 1, 2018

(30) Foreign Application Priority Data

Aug. 1, 2016 (CN) ..... 2016 1 0631222

(51) Int. Cl.
*H01R 13/447* (2006.01)
*H01R 13/52* (2006.01)
*H01R 13/518* (2006.01)

(52) U.S. Cl.
CPC ..... *H01R 13/447* (2013.01); *H01R 13/518* (2013.01); *H01R 13/5213* (2013.01)

(58) Field of Classification Search
CPC . H01R 13/447; H01R 13/443; H01R 13/5213
USPC ..... 439/148, 940, 519, 521, 135, 136, 145, 439/142, 143
See application file for complete search history.

(56) References Cited

U.S. PATENT DOCUMENTS 5,803,537 A * 9/1998 Langmeser ..... B60N 2/793 297/188.19
6,135,582 A * 10/2000 Schuelke ..... H04M 1/0252 312/223.1
6,408,171 B1 * 6/2002 Schuelke ..... H04M 1/0252 312/223.1
6,991,490 B1 * 1/2006 Su ..... H01R 13/5213 439/136
7,048,556 B2 * 5/2006 Stanton ..... H01R 13/5213 439/135

(Continued)

FOREIGN PATENT DOCUMENTS

JP 2005-011693 A 1/2005
JP 2010-186562 A 8/2010

(Continued)

*Primary Examiner* — Ross Gushi
(74) *Attorney, Agent, or Firm* — Jeffrey K. Jacobs

(57) ABSTRACT

The present disclosure provides an electrical connector assembly which comprises: a mounting frame having a connector mounting space and at least one mating opening; a protective cover which can cover and latch with and uncover the mounting frame and comprises an outer cover made of a hard material and an inner cover made of a soft material, an inner surface of the outer cover is engaged with an outer surface of the inner cover, the protective cover is further provided with a strap, the strap connects with the mounting frame so as to allow the protective cover to move between an open position and a close position; and at least one connector having a connector mating portion, the connector is received and fixed in the connector mounting space, and the connector mating portion is exposed via the mating opening. The protective cover of the electrical connector assembly of the present disclosure has the advantage of being easy to operate, feel good and beautiful in appearance.

7 Claims, 7 Drawing Sheets

(56) References Cited

U.S. PATENT DOCUMENTS 7,083,439 B1 * 8/2006 Hayakawa ..... H01R 13/443 439/136
7,189,084 B2 * 3/2007 Iikura ..... H01R 13/443 439/135
7,309,016 B2 * 12/2007 Lev ..... G06F 1/183 235/380
7,338,140 B1 * 3/2008 Huang ..... G06F 1/181 312/223.2
7,338,315 B2 * 3/2008 Fauriot ..... H01R 13/447 439/535
7,500,866 B2 * 3/2009 Gennai ..... H01R 13/447 439/367
7,563,113 B2 * 7/2009 Sheng ..... H01R 13/5213 439/135
7,572,993 B2 * 8/2009 Chen ..... H01R 13/447 200/302.1
7,611,371 B2 * 11/2009 Guo ..... H01R 13/447 439/367
7,800,891 B2 * 9/2010 Shi ..... H04M 1/0252 280/728.2
7,806,707 B1 * 10/2010 Lai ..... H01R 13/4534 439/145
7,837,484 B2 * 11/2010 Wu ..... H01R 13/4534 439/136
7,855,884 B2 * 12/2010 Dong ..... E05C 19/06 361/679.56
7,885,058 B2 * 2/2011 Li ..... H05K 5/0239 361/679.01
7,887,344 B2 * 2/2011 Ihara ..... H04M 1/0274 439/136
7,988,468 B2 * 8/2011 Yang ..... H01R 13/5213 439/135
8,007,297 B1 * 8/2011 Peng ..... H05K 9/0018 439/142
8,050,025 B2 * 11/2011 Shi ..... H05K 5/0239 132/295
8,072,746 B2 * 12/2011 Hung ..... H01R 31/06 361/679.41
8,079,867 B2 * 12/2011 Delpier ..... G06F 1/1613 439/528
8,107,227 B2 * 1/2012 Long ..... H05K 5/0239 292/57
8,155,715 B2 * 4/2012 Yang ..... H01R 13/5213 361/679.56
8,186,726 B2 * 5/2012 Zuo ..... H04M 1/0274 292/1
8,199,464 B2 * 6/2012 Zuo ..... H01R 13/447 200/302.1
8,199,470 B2 * 6/2012 Yang ..... H05K 5/0239 361/679.02
8,213,162 B2 * 7/2012 Huang ..... G06F 1/1656 200/302.1
8,218,314 B2 * 7/2012 Yang ..... H04M 1/0274 361/679.01
8,223,484 B2 * 7/2012 Zhu ..... H04M 1/0262 361/679.01
8,229,520 B2 * 7/2012 Katou ..... H01R 13/5213 455/550.1
8,251,409 B2 * 8/2012 Chang ..... H04M 1/0249 292/1
8,254,138 B2 * 8/2012 Ouyang ..... H04M 1/18 361/730
8,337,222 B2 * 12/2012 Hung ..... H01R 13/447 439/138
8,345,416 B2 * 1/2013 Liang ..... H05K 5/0239 361/679.31
8,355,260 B2 * 1/2013 Kang ..... G06F 1/1656 361/752
8,395,887 B2 * 3/2013 Zhang ..... H01R 13/443 361/679.01
8,419,459 B2 * 4/2013 Nihei ..... H01R 13/5213 439/341
8,430,680 B2 * 4/2013 Sun ..... H01R 13/44 439/217
8,496,488 B2 * 7/2013 Grimm ..... H01R 9/2425 439/144
8,636,525 B2 * 1/2014 Sobig ..... H01R 13/447 439/136
8,657,546 B2 * 2/2014 Kang ..... H05K 5/0239 411/372.5
8,662,905 B2 * 3/2014 Chang ..... H01R 13/447 439/142
8,711,568 B2 * 4/2014 Evens ..... G06F 1/1626 361/728
8,794,984 B2 * 8/2014 Chen ..... H01R 13/5213 439/136
8,824,153 B2 * 9/2014 Chang ..... G06K 7/0039 361/737
8,827,725 B2 * 9/2014 Chang ..... H01R 13/447 439/131
8,926,345 B2 * 1/2015 Kim ..... G06K 13/0825 439/142
8,934,224 B2 * 1/2015 Iwamoto ..... H01R 13/447 292/11
9,014,767 B2 * 4/2015 Tanaka ..... H01R 13/5213 455/575.1
9,083,109 B2 * 7/2015 Tetsuya ..... H01R 13/447
9,203,173 B2 * 12/2015 Wang ..... H01R 13/447
9,236,681 B2 * 1/2016 Yu ..... H01R 13/5219
9,250,659 B2 * 2/2016 Tsai ..... G06F 1/181
9,317,077 B2 * 4/2016 Mori ..... G06F 1/1616
9,345,158 B2 * 5/2016 Shao ..... H05K 5/03
9,387,647 B2 * 7/2016 Wei ..... H04B 1/3816
9,812,832 B2 * 11/2017 Su ..... H01R 13/5213
2002/0119697 A1 * 8/2002 Chan ..... H01R 13/5213 439/519
2004/0258336 A1 * 12/2004 Hou ..... H04M 1/0214 384/276
2005/0124191 A1 * 6/2005 Stanton ..... H01R 13/5213 439/135
2005/0181640 A1 * 8/2005 Iikura ..... H01R 13/443 439/66
2006/0154520 A1 * 7/2006 Gennai ..... H01R 13/447 439/578
2006/0154532 A1 * 7/2006 Yamada ..... B60R 16/0239 439/701
2006/0231619 A1 * 10/2006 Lee ..... G06K 13/08 235/441
2007/0004255 A1 * 1/2007 Kuo ..... H01R 13/5213 439/136
2007/0275772 A1 * 11/2007 Moon ..... H04M 1/236 455/575.1
2008/0268706 A1 * 10/2008 Sheng ..... H01R 13/5213 439/587
2009/0111539 A1 * 4/2009 Matsuda ..... G06F 1/1616 455/575.3
2009/0130875 A1 * 5/2009 Guo ..... H01R 13/447 439/141
2009/0225520 A1 * 9/2009 Shi ..... H04M 1/0274 361/728
2009/0270144 A1 * 10/2009 Yang ..... H01R 13/5213 455/575.3
2009/0270145 A1 * 10/2009 Yang ..... H01R 13/5213 455/575.3
2009/0314044 A1 * 12/2009 Yang ..... H04M 1/0202 70/158
2009/0322191 A1 * 12/2009 Chang ..... H04M 1/0249 312/223.1
2010/0033913 A1 * 2/2010 Cao ..... G06F 1/181 361/679.4
2010/0062323 A1 * 3/2010 Dong ..... H01M 2/1066 429/96
2010/0119924 A1 * 5/2010 Wang ..... H01M 2/1066 429/98
2010/0128420 A1 * 5/2010 Li ..... H05K 5/0239 361/679.01
2010/0203749 A1 * 8/2010 Ihara ..... H04M 1/0274 439/135

(56) References Cited

U.S. PATENT DOCUMENTS

2010/0210125 A1* 8/2010 Wu ..... H01R 13/4534 439/136
2010/0236151 A1* 9/2010 Chung ..... G06F 1/181 49/319
2010/0264671 A1* 10/2010 Zuo ..... H04M 1/0274 292/57
2010/0309613 A1* 12/2010 Zuo ..... H01R 13/447 361/679.01
2011/0032664 A1* 2/2011 Long ..... H04M 1/0274 361/679.01
2011/0063780 A1* 3/2011 Yang ..... H05K 5/0239 361/679.01
2011/0069429 A1* 3/2011 Zhu ..... H04M 1/0262 361/679.01
2011/0157804 A1* 6/2011 Chen ..... G06F 1/1616 361/679.14
2011/0188818 A1* 8/2011 Sun ..... G02B 6/36 385/94
2011/0211300 A1* 9/2011 Mori ..... G06F 1/1656 361/679.01
2011/0211318 A1* 9/2011 Ouyang ..... H04M 1/0274 361/752
2012/0015535 A1* 1/2012 Lin ..... G06F 1/1633 439/136
2012/0050962 A1* 3/2012 Hsiung ..... H01H 13/705 361/679.01
2012/0289069 A1* 11/2012 Chueh ..... H01R 13/443 439/135
2013/0023136 A1* 1/2013 Kim ..... G06K 13/0825 439/153
2013/0114225 A1* 5/2013 Schack ..... H05K 5/0208 361/781
2013/0122727 A1* 5/2013 Liao ..... H01R 13/4534 439/136
2013/0222986 A1* 8/2013 Nakatsu ..... H04N 5/2251 361/679.01
2013/0244461 A1* 9/2013 Munehiro ..... H01R 13/5213 439/136
2013/0314854 A1* 11/2013 Chung ..... H05K 5/0239 361/679.01
2013/0334948 A1* 12/2013 Chung ..... H05K 7/1461 312/333
2014/0038441 A1* 2/2014 Chen ..... H01R 13/5213 439/136
2014/0065860 A1* 3/2014 Wang ..... H01R 13/447 439/136
2014/0080334 A1* 3/2014 Tetsuya ..... H01R 13/5213 439/136
2014/0115967 A1* 5/2014 Lin ..... H01R 13/447 49/258
2014/0247568 A1* 9/2014 Lin ..... H04B 1/3818 361/754
2016/0360630 A1* 12/2016 Oda ..... A45C 11/00

FOREIGN PATENT DOCUMENTS

JP 2015-076370 A 4/2015
JP 2016-096102 A 5/2016

* cited by examiner

ELECTRICAL CONNECTOR ASSEMBLY

RELATED APPLICATIONS

This application claims priority to Chinese Application No. 201610631222.2, filed Aug. 1, 2016, which is incorporated herein by reference in its entirety.

TECHNICAL FIELD

The present disclosure relates to an electrical connector assembly, particularly relates to an electrical connector assembly having a protective cover.

BACKGROUND ART

It is generally known that a variety of connector interfaces (such as a USB (universal serial bus) interface, an AUX interface (audio input interface), a SD card (secure digital card) interface, a HDMI interface (high-definition multimedia interface), etc.) are often provided on an electronic device (such as a desktop computer, a laptop, a mobile phone, etc.). Since these interfaces need to connect with external connectors when these interfaces are used, these interfaces cannot be covered by a casing of the electronic device when these interfaces are used. For needs of the dust-proof, protection interface and beautiful appearance, protective covers can be used to cover these interfaces when these interfaces are not used. These protective covers are designed to be detachable so that they do not block the connection of the external connectors with these interfaces when these interfaces are required to use.

However, since the connector interfaces need to be used frequently, accordingly, these protective covers need to frequently cover and uncover, therefore, these protective covers are often lost due to that the operator forgets to cover the protective covers when the connector interfaces are not used.

In order to solve the above problem, a protective cover is disclosed in Chinese Patent Application No. 200710202572.8. As shown in FIG. 1, the protective cover 32 is made of plastic or soft rubber and is formed by an integral molding technique (e.g., injection molding). An inner surface 68 of a bottom plate 60 of a casing is provided with a fixing rod 64 which comprises a fixing end 642 and a free end 644 and substantially forms a T-shape, a mounting part 34 of the protective cover 32 passes through a through hole 620 of the bottom plate 60 of the casing and makes a sliding groove 342 sheathe onto the fixing end 642 of the fixing rod 64 so that the protective cover 32 can slide relative to the fixing rod 64. When the protective cover 32 is pulled out, the sliding groove 342 moves relative to the fixing rod 64, and when the fixing rod 64 contacts the lowermost end of the sliding groove 342, the fixing rod 64 prevents the protective cover 32 from being further pulled out.

However, as can be seen from the above disclosed content, the fixing rod 64 needs to be provided on the bottom plate 60 of the casing, the through hole 620 for passing and sheathing of the mounting part 34 also needs to be provided on the bottom plate 60 of the casing, these are all additional structures that are added on the casing. These additional structures will increase the complexity of the construction and the manufacturing difficulty of the casing. Moreover, one choice of the protective cover 32 is made of a hard plastic, or another alternative is made of soft rubber, both of which have their own disadvantages, for example, the operation is not easy to open the protective cover or close the protective cover, or feel is bad, or appearance is not beautiful and so on.

SUMMARY

In order to solve at least one of the above problems, one object of the present disclosure is to provide an electrical connector assembly with good latching effect.

To achieve this object and other advantages, and in accordance with the object of the present disclosure, as specifically embodied and broadly described herein, an electrical connector assembly comprises: a mounting frame having a connector mounting space and at least one opening; a protective cover which can cover and latch with and uncover the mounting frame and comprise an outer cover made of a hard material and an inner cover made of a soft material, an inner surface of the outer cover is engaged with an outer surface of the inner cover, the protective cover is further provided with a strap, the strap connects with the mounting frame so as to allow the protective cover to move between an open position where the protective cover uncovers the mounting frame and a close position where the protective cover covers and latches with the mounting frame; and at least one connector having a connector mating portion, the connector is received and fixed in the connector mounting space, and the connector mating portion is exposed via the opening.

In an embodiment, the mounting frame further has: a through hole communicating the inside and the outside of the mounting frame; and a connecting block positioned in the inside of the mounting frame, the strap has an elongated rail groove, the strap passes through the through hole and sheathes onto the connecting block by means of the rail groove, the connecting block is able to move relative to the rail groove.

In an embodiment, the inner cover further has a latching protrusion, the mounting frame further has a latching groove, the latching protrusion is the same as the latching groove in number and the latching protrusion corresponds to the latching groove in position, the latching between the protective cover and the mounting frame is achieved by the latching protrusion being latched with the latching groove.

In an embodiment, the strap and the latching protrusion are integrally formed on the inner cover.

In an embodiment, the inner cover has a protruding block corresponding to the opening, and when the protective cover is in the close position, the protruding block extends into the opening and engage with the connector mating portion.

In an embodiment, one end of the inner surface of the outer cover has a recessed portion, and a side of the recessed portion is exposed to the outside.

In an embodiment, when the protective cover is in the open position, the rail groove is not exposed outside the mounting frame.

In an embodiment, an outer surface of the outer cover is formed with a mark indicating a type of the connector.

In an embodiment, the material forming the outer cover is PC, ABS or PBT.

In an embodiment, the material forming the inner cover is TPE or rubber.

In an embodiment, the at least one connector comprises a first connector and a second connector, the outer cover comprises a first cover portion and a second cover portion which are independent from each other, the first cover portion and the second cover portion respectively cover the connector mating portion of the first connector and the connector mating portion of the second connector when the protective cover is in the close position, a region of the inner cover where the inner cover is engaged with the first cover portion and a region of the inner cover where the inner cover is engaged with the second cover each are provided with the latching protrusion.

In the present disclosure, the protective cover of the connector assembly can be directly mounted on the mounting frame and do not need to be provided on the casing of the electronic device onto which the connector assembly is mounted, and the casing of the electronic device onto which the connector assembly is mounted only needs to open a hole, so that the structure and manufacturing difficulty of the casing are greatly reduced. The protective cover of the connector assembly is divided into two parts which are the outer cover and the inner cover. The outer cover uses a harder material, and the inner cover uses a softer material. When the protective cover is covered and latched and pried, the operator's finger directly contacts the harder outer cover, which is convenient to apply a force to the protective cover, the feel of pressing and prying is good, and the inner cover contacting the mounting frame is softer and is easily deformed so that the protective cover can easily cover and latch with the mounting frame and uncover the mounting frame. In addition, the harder outer cover is also convenient to form a beautiful appearance and shape.

BRIEF DESCRIPTION OF THE DRAWINGS

The organization and manner of the structure and operation of the present disclosure, together with further objects and advantages thereof, may best be understood by reference to the following detailed description, taken in connection with the accompanying Figures in which like reference numerals identify like elements, and in which.

DETAILED DESCRIPTION OF THE PREFERRED EMBODIMENTS

While the disclosure may be susceptible to embodiment in different forms, there is shown in the Figures, and herein will be described in detail, specific embodiments with the understanding that the present specifications is to be considered an exemplification of the principles of the disclosure, and is not intended to limit the present disclosure to the Figures shown herein.

Similarly, references to a feature or aspect are intended to describe a feature or aspect of an example of the present disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
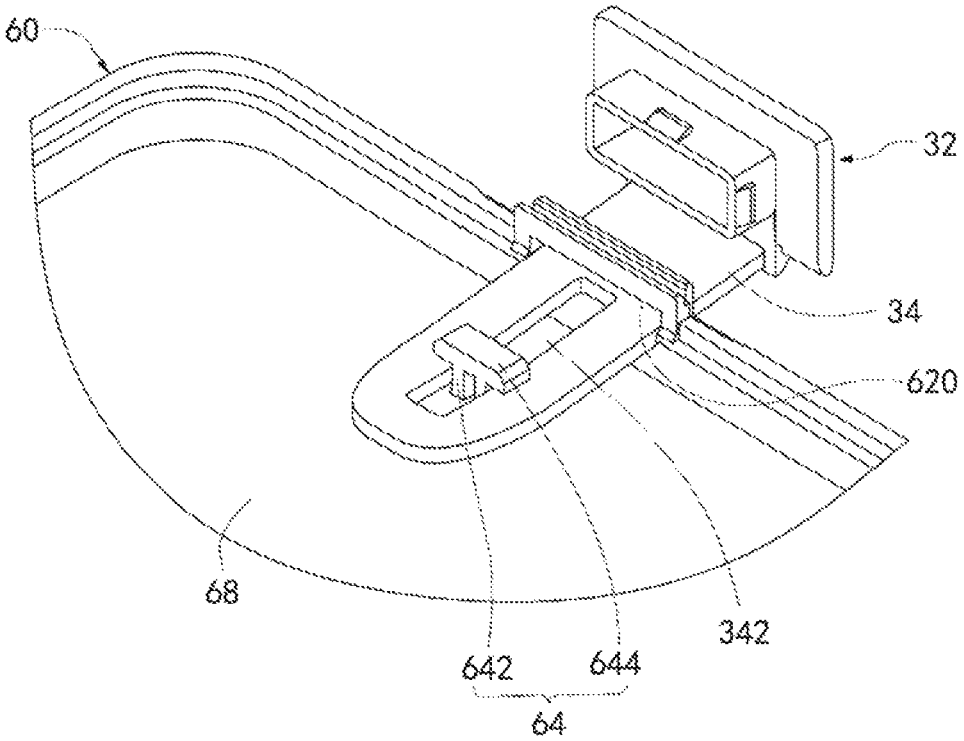
FIG. 1 illustrates a perspective view of a protective cover for an electrical connector and a part of a bottom plate of a casing in the prior art.
Figure 2:
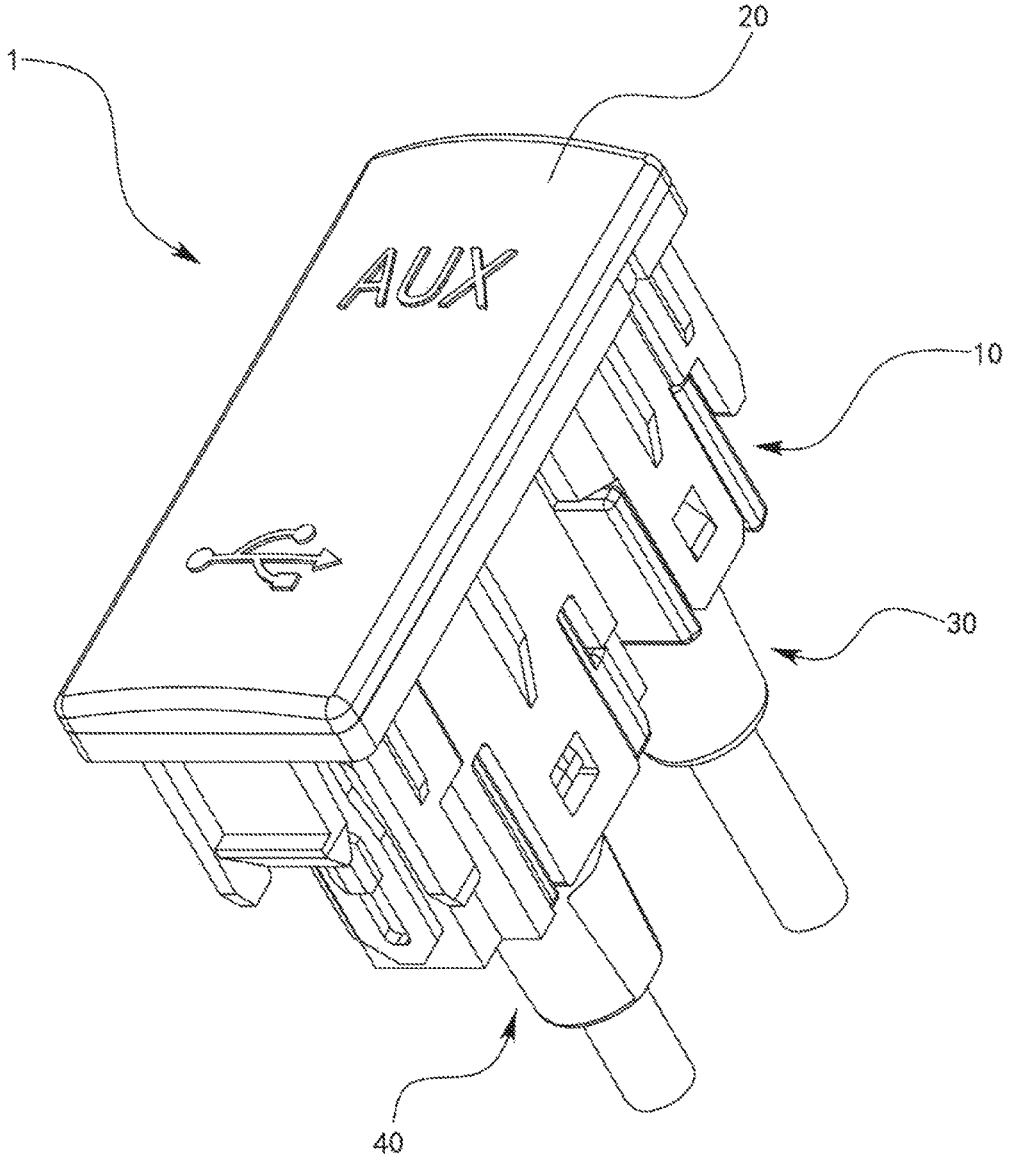
FIG. 2 illustrates a top perspective view of an electrical connector assembly of the present disclosure after assembled.

Referring to FIG. 2, FIG. 2 illustrates a top perspective view of an electrical connector assembly of the present disclosure after assembled. The electrical connector assembly 1 of the present disclosure comprises a mounting frame 10, a protective cover 20, a first connector 30 and a second connector 40 which can be combined with each other and fixed together so as to form the electrical connector assembly 1. In other embodiments, the electrical connector assembly 1 may only comprise one of the first connector 30 and the second connector 40 or may comprise other connector besides the first connector 30 and the second connector 40.

Figure 3:
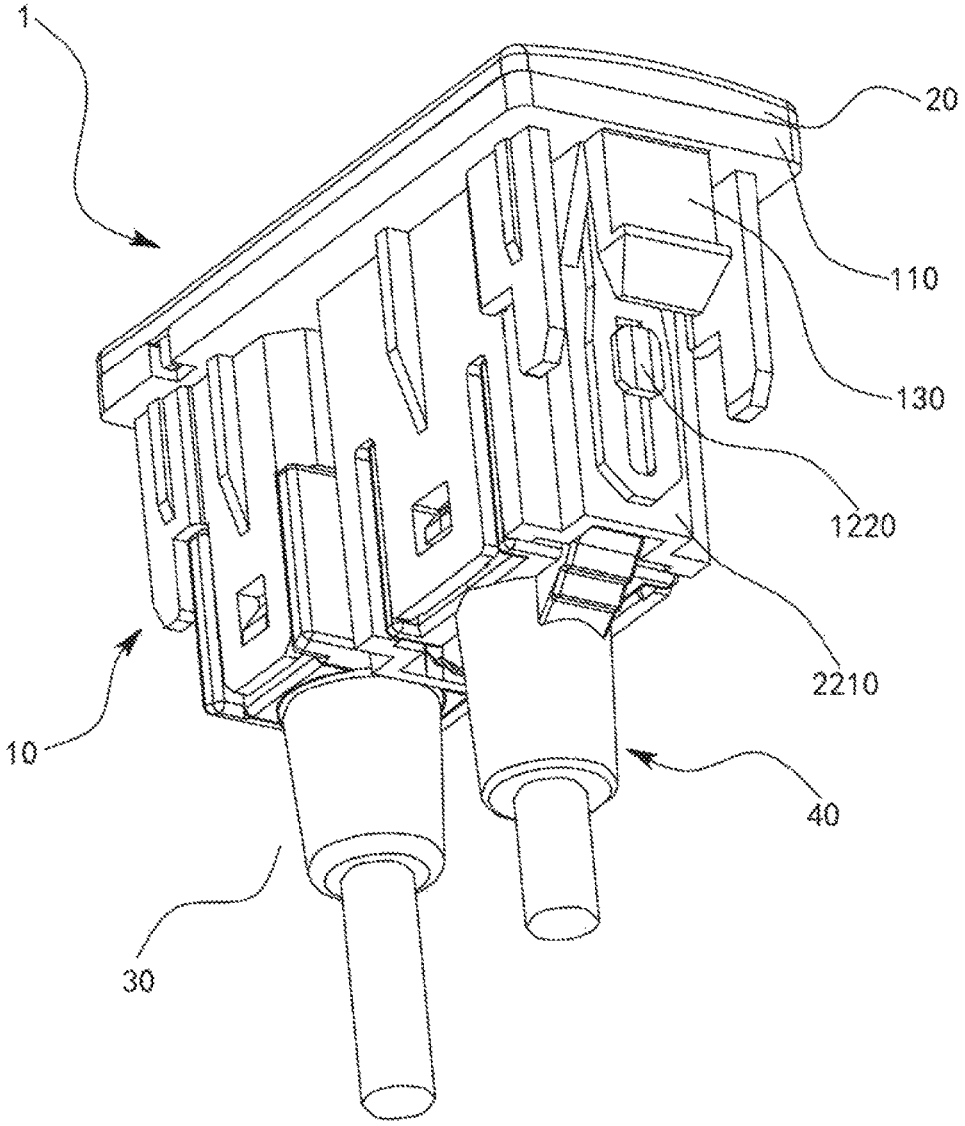
FIG. 3 illustrates a bottom perspective view of the electrical connector assembly of the present disclosure after assembled.
Figure 4:
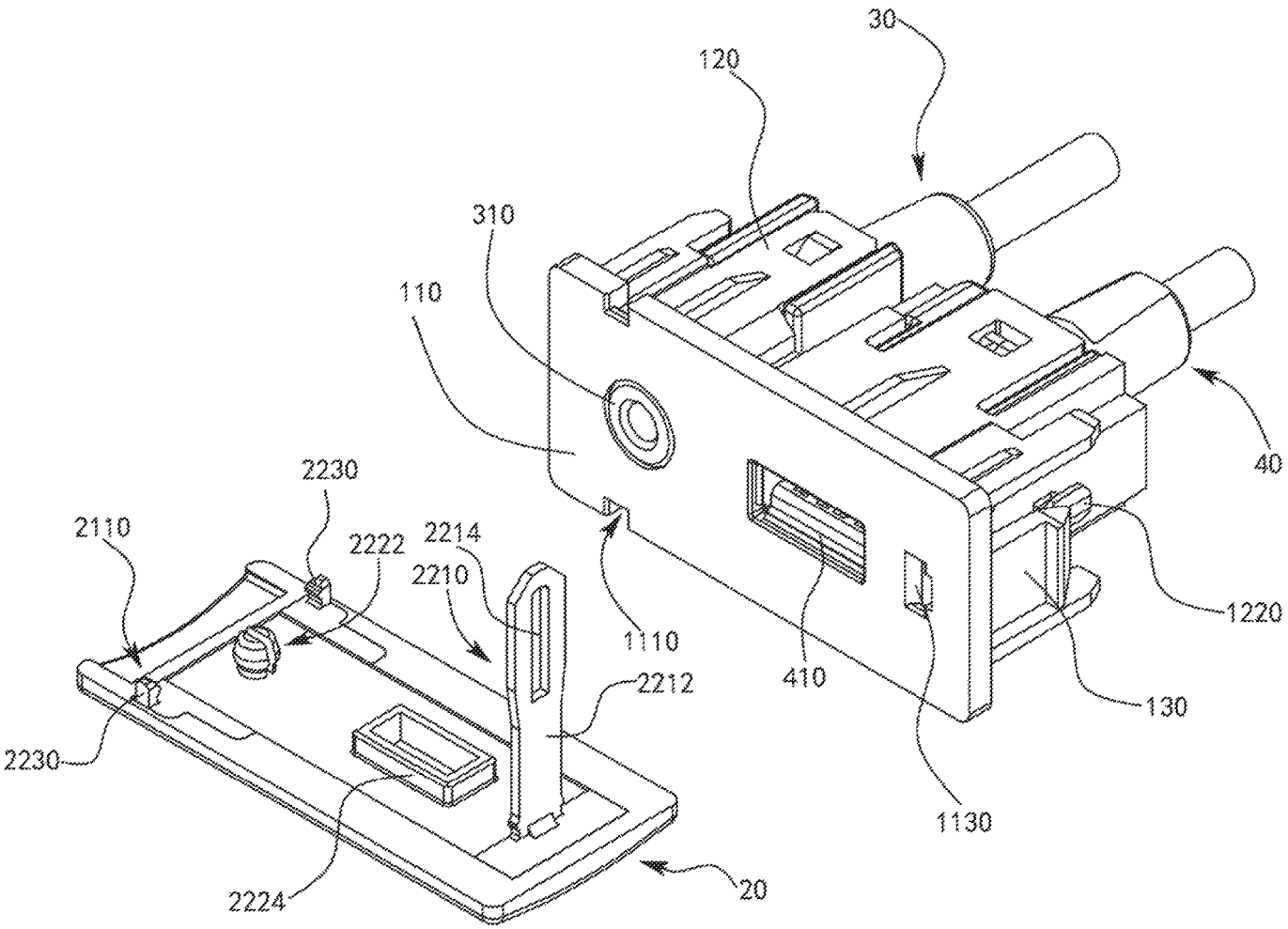
FIG. 4 illustrates an exploded perspective view of the electrical connector assembly of the present disclosure in which the protective cover is separated from a mounting frame.
Figure 5:
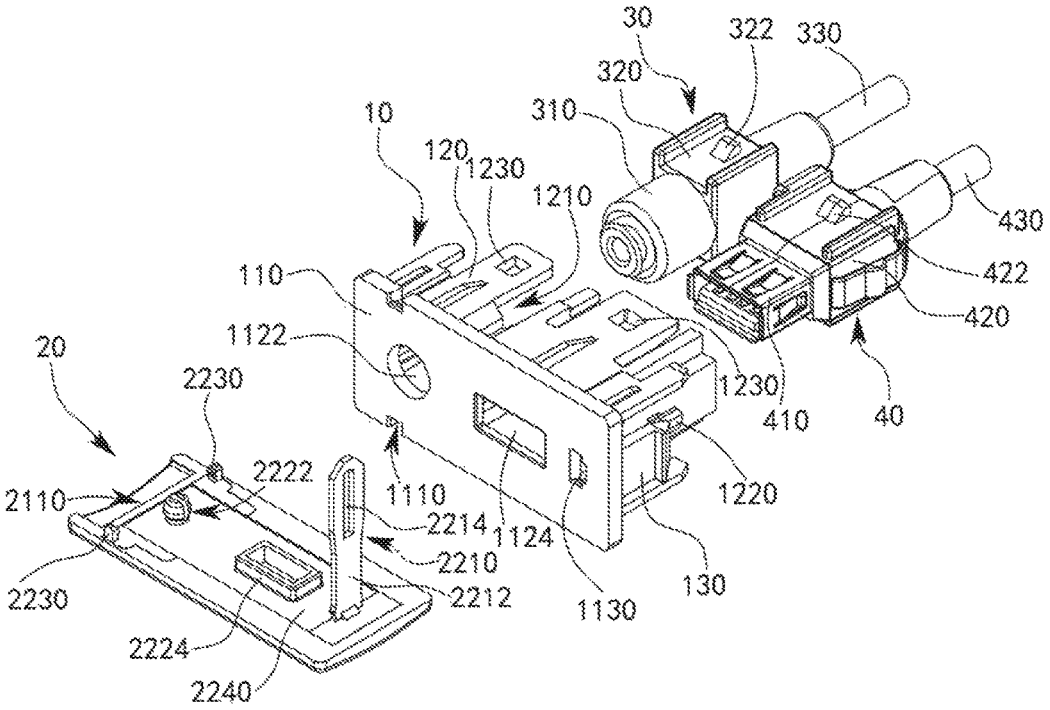
FIG. 5 illustrates an exploded perspective view of the electrical connector assembly of the present disclosure in which the protective cover, the mounting frame and the connector are separated from each other.

Referring to FIGS. 3-5, the mounting frame 10 has a mating portion 110, a connector receiving portion 120 and a mounting portion 130. The protective cover 20 can cover and latch with the mating portion 110 of the mounting frame 10 so as to be retained on the mounting frame 10. The first connector 30 and the second connector 40 can be received and fixed in the connector receiving portion 120 of the mounting frame 10. The whole electrical connector assembly 1 can be fixed on an electronic device on which the electrical connector assembly 1 needs to be mounted via the mounting part 130. For example, an opening can be simply opened on a casing of the electronic device, and the electrical connector assembly 1 is mounted on the opening via the mounting portion 130. The mounting portion 130 can be formed in a form of a latch arm as shown in the figure so as to be latch and fixed onto the opening on the casing of the electronic device. However, the form of the latch arm is only an example, and the electrical connector assembly 1 can be mounted on the corresponding electronic device in any suitable way. In the embodiment, the mounting portion 130 is provided as two in number (only one of the mounting portions 130 is shown in FIG. 3 to FIG. 5 and the other is on a side of the electrical connector assembly 1 opposite to the illustrated mounting portion 130). However, the mounting portion 130 can also be provided as other quantity, such as 1, 4, 6, and so on.

Figure 6:
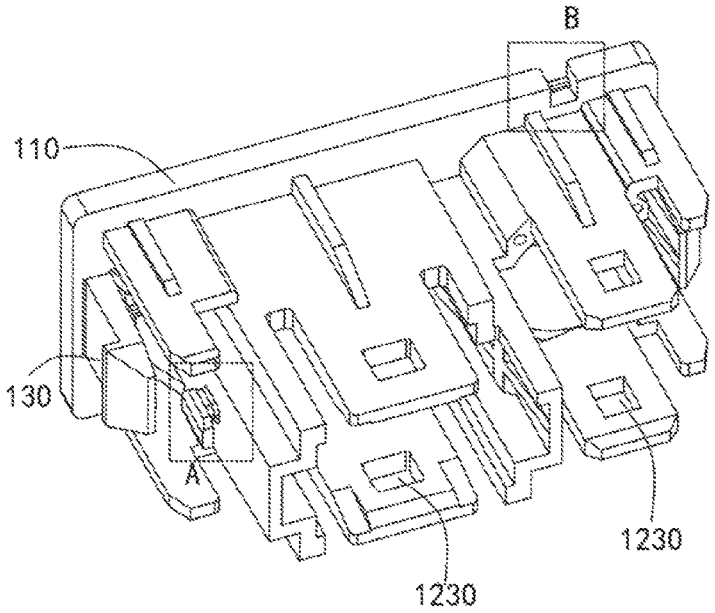
FIG. 6 illustrates a bottom perspective view of the mounting frame of the electrical connector assembly of the present disclosure.
Figure 6A:
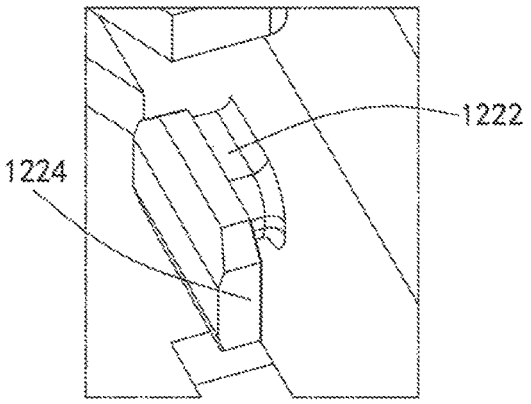
FIG. 6A illustrates an enlarged partial view of an area A in FIG. 6.
Figure 6B:
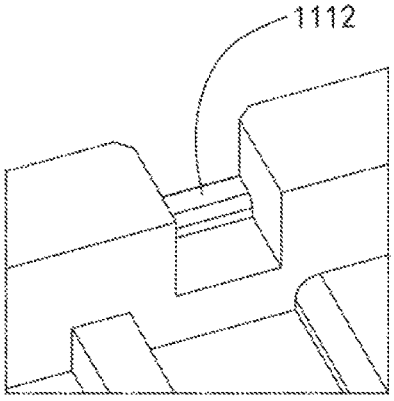
FIG. 6B illustrates an enlarged partial view of an area B in FIG. 6.

Referring to FIGS. 5-6B, the mating portion 110 of the mounting frame 10 is a substantially rectangular plate structure, which is provided with a latching groove 1110, mating openings 1122, 1124 and a through hole 1130. The latching groove 1110 is a recessed groove formed on a side edge of the mating portion 110 and has a protruding ridge portion 1112 on a side (an upper side in FIG. 6) of the latching groove 1110, the protruding ridge portion 1112 can be engaged with a latching protrusion 2230 (see FIG. 5) which will be described later. In the embodiment, the latching groove 1110 is provided as two in number which are positioned at edges of opposite sides (upper and lower sides in FIG. 5) of the mating portion 110 toward one end (toward a left end of FIG. 5) of the mating portion 110. The through hole 1130 is a through hole provided at a position the mating portion 110 toward the other end (toward a right end of FIG. 5) of the mating portion 110. The mating openings 1122, 1124 are similarly through holes on the mating portion 110. In the embodiment, the mating openings 1122, 1124 comprises a first mating opening 1122 which is circular and a second mating opening 1124 which is rectangular. It will be understood that the mating openings 1122, 1124 are not limited to those in shape and number, but can be differently provided in number and shape depending on the specific needs. The first mating opening 1122 and the second mating opening 1124 can be respectively aligned with the first connector 30 and the second connector 40 to allow external connectors to respectively insert into the connectors 30, 40.

The connector receiving portion 120 and the mounting portion 130 are integrally formed on one side surface of the mating portion 110. The connector receiving portion 120 can encompass a connector mounting space 1210 which receives connector mating portions 310, 410 (described below) and connector main portions 320, 420 (described in detail below) of the first connector 30 and the second connector 40. The connector receiving portion 120 is provided with latching holes 1230, a connecting block 1220 and a plurality of reinforced ribs. A position of the connecting block 1220 corresponds to the through hole 1130. As can be clearly seen from FIG. 6A, the connecting block 1220 has a shape similar to an umbrella (or a mushroom) and has a neck portion 1222 and an enlarged head portion 1224. An outer periphery of the enlarged head portion 1224 is significantly larger than an outer periphery of the neck portion 1222.

In the embodiment, the first connector 30 and the second connector 40 respectively are an AUX connector and a USB connector. However, the first connector 30 and the second connector 40 can also be other connectors, such as one or more of the AUX connector, the USB connector, a SD card connector and a HDMI connector. In addition, the connectors may not be limited to two in number (i.e., the first connector 30 and the second connector 40), and may be provided as one, three, or more in number as desired. The first connector 30 and the second connector 40 respectively have a connector mating portion 310, 410 for insertion of the external connector, a connector main portion 320, 420 provided with a latch 322,422 on a surface thereof and a cable 330, 430 connecting conductive terminals of the first connector 30 and the second connector 40. The first connector 30 and the second connector 40 are fixed in the connector mounting space 1210 by mean of the latch 322, 422 engaging with the latching holes 1230. The number of latches 322, 422 can be any number as long as the number of latches 322, 422 is the same as the number of latching holes 1230. In the embodiment, the number of the latches 322,422 is four (i.e., two latches 322, two latches 422). When the electrical connector assembly 1 is in an assembled state (as shown in FIGS. 2-3), the connector mating portions 310, 410 can be respectively positioned at the first mating opening 1122 and the second mating opening 1124.

Figure 7:
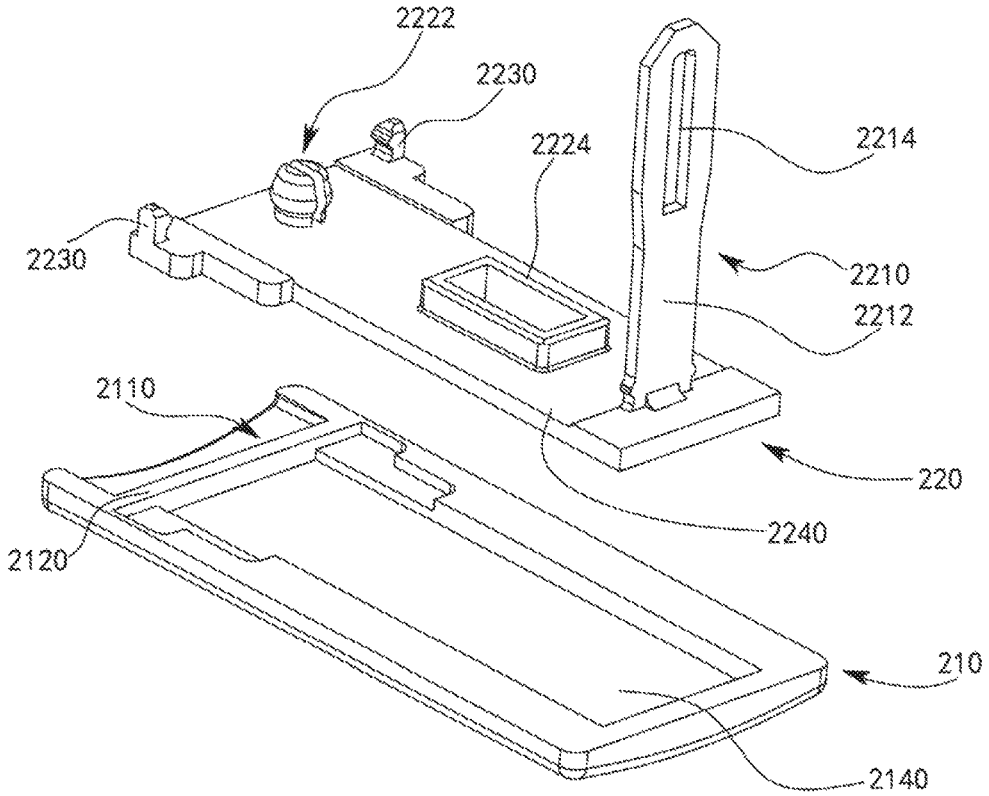
FIG. 7 illustrates an exploded perspective view of the protective cover of the electrical connector assembly of the present disclosure.

Then referring to FIG. 5 and FIG. 7, the protective cover 20 can have a rectangular shape whose outer peripheral contour is substantially the same as an outer peripheral contour of the mating portion 110 of the mounting frame 10 and comprises an outer cover 210 and an inner cover 220. The outer cover 210 has: a recessed portion 2110 provided at one end in a length direction of the rectangular protective cover 20 and forms a cavity which is opened to the outside at one end of the cavity to allow an operator's finger to insert therein; an accommodating cavity 2140 having a shape which is substantially the same as an outer peripheral contour of the inner cover 220 so that inner surfaces of the whole protective cover 20 are in the same plane after the inner cover 220 is engaged with the outer cover 210; and a rib portion 2120 partitioning the recessed portion 2110 and the accommodating cavity 2140. An outer surface of the outer cover 210 (a surface opposite to the accommodating cavity 2140) may be formed with marks, such as letters, digits, symbols or patterns and the like, to provide the operator with information that which connector interface is covered below a position of the mark of the protective cover 20 (as shown in FIG. 2). The above marks may be formed on the outer cover 210 in any suitable manner, such as integrally molded with the outer cover 210, laser etching, spraying and the like. Also, the above marks can be formed in such a way that the marks are recessed in the outer cover 210 or protrude from the outer cover 210. Preferably, the marks are formed in a protruding form by being integrally molded with the outer cover 210. The outer surface of the outer cover 210 can have a certain curvature which can be adapted to a shape of the casing of the electronic device to which the outer cover 210 is applied. The inner cover 220 has: an inner cover body portion 2240 formed with a sheet body; and a straight elongated strap 2210 provided on the inner cover body portion 2240 and positioned near an end of the protective cover 20 opposite to the recessed portion 2110, the strap 2210 has a strap body portion 2212 and an elongated rail groove 2214 provided toward one side of the strap body portion 2212; and a first protruding block 2222 and a second protruding block 2224 provided on the inner cover body portion 2240 and arranged in the length direction of the protective cover 20; and two latching protrusions 2230 also provided on the inner cover body portion 2240 and positioned respectively at both side edges of the protective cover 20 at one end of the inner cover body portion 2240 which is the same end as the end where the recessed portion 2110 is present. The outer cover 210 and the inner cover 220 are made of different materials. Specifically, the outer cover 210 can be molded from a harder, higher strength material (such as PC, ABS, PBT, etc.). The inner cover 220 can be molded from a softer, higher elasticity material (such as TPE, rubber, etc.). The outer cover 210 and the inner cover 220 can be firmly engaged together in a certain way (such as injection molding, or bonding and the like). The outer cover 210 has greater hardness and strength than the inner cover 220.

The strap 2212, the first protruding block 2222, the second protruding block 2224 and the latching protrusions 2230 are all integrally formed with the inner cover body portion 2240. As shown in FIG. 7, the first protruding block 2222 comprises two wedge-shaped halves which leave a gap therebetween. The second protruding block 2224 is formed as an annular rib in form of "mouth". When the protective cover 20 covers on the mounting frame 10, the first protruding block 2222 and the second protruding block 2224 respectively insert into the first mating opening 1122 and the second mating opening 1124, or respectively extend into the connector mating portion 310 of the first connector 30 and the connector mating portion 410 of the second connector 40. The strap 2210 can pass through the through hole 1130 on the mounting frame 10 and sheath on the connecting block 1220 so as to be slidably connected. The two latching protrusions 2230 can be respectively latched with the two latching grooves 1110 of the mounting frame 10.

Hereinafter, an assembling process of the electrical connector assembly 1 will be described in detail referring to FIG. 5. First, the first connector 30 and the second connector 40 are inserted and mounted into the connector mounting space 1210 of the mounting frame 10 from the rear of the mounting frame 10. A height of the first connector 30 and a height of the second connector 40 each are slightly greater than a height of the connector mounting space 1210 formed by the connector receiving portion 120 due to the presence of the latches 322, 422. Thus, during the insertion of the first connector 30 and the second connector 40, the connector receiving portion 120 will generate slight elastic deformation due to squeeze of the first connector 30 and squeeze of the second connector 40. When the first connector 30 and the second connector 40 are mounted in place, the latches 322, 422 respectively extend into the latching holes 1230 so that the connector receiving portion 120 returns to the initial shape of the connector receiving portion 120. At this time, since the latching holes 1230 restrict the latches 322, 422 therein, the first connector 30 and the second connector 40 are fixed in the connector mounting space 1210 (as shown in FIG. 4).

Then, the strap 2210 of the protective cover 20 passes through the through hole 1130 on the mating portion 110, and extends into the position where the connecting block 1220 is present. Next, under the action of external force, the enlarged head portion 1224 of the connecting block 1220 passes through the rail groove 2214 of the strap 2210. A width of the enlarged head portion 1224 is significantly greater than a width of the rail groove 2214 to ensure that the strap 2210 does not detach from the connecting block 1220 when the protective cover 20 moves. As the rail groove 2214 has a certain length, the strap 2210 can slide within the above length relative to the connecting block 1220. Finally, the protective cover 20 covers onto the mating portion 110 of the mounting frame 10, in which the latching protrusions 2230 of the protective cover 20 are respectively aligned with the latching grooves 1110 of the mating portion 110, and the first protruding block 2222 and the second protruding block 2224 of the protective cover 20 are respectively aligned with the first mating opening 1122 and the second mating opening 1124 of the mating portion 110. Due to the blocking of the protruding ridge portion 1112 of the latching groove 1110 to the latching protrusions 2230 and the relative movement resistance caused by the first protruding block 2222 and the second protruding block 2224 respectively engaging with the first mating opening 1122 and the second mating opening 1124, the mounting frame 10 has a certain retaining force to the protective cover 20 so that the protective cover 20 will not easily detach from the mounting frame 10 when the protective cover 20 covers onto the mounting frame 10. The assembled electrical connector assembly 1 can be wholly mounted on an electronic device to which the assembled electrical connector assembly is applied via the mounting portion 130.

The assembled electrical connector assembly 1 has two use positions, the protective cover 20 moved between an open position and a close position. The open position is a position where the protective cover 20 uncovers the mounting frame and the close position is a position where the protective cover 20 covers and latch with the mounting frame 10. The close position is described as the above assembling process (hereinafter is not repeated). The open position of the protective cover 20 is that the connector mating portions 310, 410 of the electrical connector assembly 1 need to be used. An operation from the close position to the open position is that an operator puts a distal end of a finger into the recessed portion 2110 and then applies a force to the protective cover 20 in a direction away from the mounting frame 10, and the force overcomes the retaining force of the mounting frame 10 to the protective cover 20 so that the protective cover 20 takes one end of the protective cover 20 away from the recessed portion 2110 as a fulcrum and is opened (or is pried), and when the latching protrusions 2230, the first protruding block 2222, and the second protruding block 2224 are respectively detached from the latching grooves 1110, the first mating opening 1122 and the second mating opening 1124, the protective cover 20 may be further away from the mounting frame 10 and expose the connector mating portion 310 of the first connector 30 and the connector mating portion 410 of the second connector 40 due to gravity of the protective cover 20 or the continuously applied force of the operator. Due to restriction of the connection of the strap 2210 with the connecting block 1220, the movement of the protective cover 20 stops when the protective cover 20 is moved away from the mounting frame 10 so that the connecting block 1220 contacts a distal end of the rail groove 2214 away from the protective cover 20. It should be noted that the length of the rail groove 2214 of the strap 2210 can be set so that the rail groove 2214 will be not exposed to a surface of the mating portion 110 when the protective cover 20 is pulled out to the farthest position (i.e., the connecting block 1220 contacts the distal end of the rail groove 2214 away from the protective cover 20 as above). Thus, it can ensure that the through hole 1130 is in a sealed state in any case and does not allow the dust or foreign matter to enter into the electrical connector assembly 1 from the through hole 1130.

Hereinafter a second embodiment of the electrical connector assembly 1 of the present disclosure will be described. Since the second embodiment is generally similar to the first embodiment, only differences between the second embodiment and the first embodiment will be described below. In the second embodiment, the strap 2210 is also provided on the inner cover 220 but is positioned in the center near an end in a width direction of the protective cover 20; and the two latching protrusions 2230 are provided on edges of two sides of an end of the inner cover 220 opposite to the strap 2210; the recessed portion 2210 is provided on the end of the outer cover 210 opposite to the strap 2210. The latching grooves 1110 and the through hole 1130 on the mating portion 110 of the mounting frame 10 and the connecting block 1220 are respectively at positions on the mounting frame 10 which respectively correspond to the latching protrusions 2230 and the strap 2210. That is, in the second embodiment, the rectangular protective cover 20 can be opened in the width direction rather than be opened in the length direction of the protective cover 20 as described in the first embodiment.

While the present disclosure has been described with reference to a number of exemplary embodiments, it should be understood that numerous other modifications and embodiments that would be apparent to those skilled in the art are fallen within the scope of the concept of the present disclosure. Specifically, various changes and modifications may be made to the components and/or devices of the primary combination device within the scope of the disclosed content, the figures and the appended claims. Alternative use will be apparent to those skilled in the art in addition to variations and modifications to the components and/or devices.

What is claimed is:

1. An electrical connector assembly, comprising:

a mounting frame having a connector mounting space and at least one mating opening;

a protective cover which can cover and latch with and uncover the mounting frame, the protective cover being provided with a strap, the strap connecting with the mounting frame so as to allow the protective cover to move between an open position and a close position, the open position being a position where the protective cover uncovers the mounting frame and the close position is a position where the protective cover covers and latches with the mounting frame; and at least one connector having a connector mating portion, the connector being received and fixed in the connector mounting space, and the connector mating portion exposing via the mating opening, wherein the protective cover comprises an outer cover and an inner cover which are engaged with each other, the outer cover is formed by a material which is hard and the inner cover is formed by a material which is soft, and wherein one end of the inner surface of the outer cover has a recessed portion, and a side of the recessed portion is exposed to the outside.

2. The connector assembly according to claim 1, wherein the mounting frame further comprises: a through hole communicating the inside and the outside of the mounting frame; and a connecting block positioned in the inside of the mounting frame, the strap has an elongated rail groove, the strap passes through the through hole and sheathes onto the connecting block by means of the rail groove, the connecting block is able to move relative to the rail groove.

3. The connector assembly according to claim 2, wherein when the protective cover is in the open position, the rail groove is not exposed outside the mounting frame.

4. The connector assembly according to claim 1, wherein the inner cover further has a latching protrusion, the mounting frame further has a latching groove, the latching protrusion is the same as the latching groove in number and the latching protrusion corresponds to the latching groove in position, the latching between the protective cover and the mounting frame is achieved by the latching protrusion being latched with the latching groove.

5. The connector assembly according to claim 4, wherein the strap and the latching protrusion are integrally formed on the inner cover.

6. The connector assembly according to claim 1, wherein the inner cover has a protruding block corresponding to the mating opening, and when the protective cover is in the close position, the protruding block extends into the mating opening.

7. The connector assembly according to claim 1, wherein an outer surface of the outer cover is formed with a mark indicating a type of the connector.

* * * * *